US005605206A

United States Patent [19]

Ries et al.

[11] Patent Number: 5,605,206

[45] Date of Patent: Feb. 25, 1997

[54] PLATFORM FOR STORAGE OR REMOVAL OF MOTOR VEHICLES IN PARKING GARAGES

[75] Inventors: Karl-Hans Ries, Gross-Umstadt; Oliver Remsberger, Obertshausen, both of Germany

[73] Assignee: Mannesmann Aktiengesellschaft, Dusseldorf, Germany

[21] Appl. No.: 513,724

[22] Filed: Aug. 11, 1995

[30] Foreign Application Priority Data

Aug. 11, 1994 [DE] Germany ..... 44 29 393.3

[51] Int. Cl.[6] ..... B66F 7/00

[52] U.S. Cl. ..... 187/203; 264/89 R

[58] Field of Search ..... 187/203, 221, 187/216; 254/90, 89 R, 93 R

[56] References Cited

U.S. PATENT DOCUMENTS 2,099,636 11/1937 Weaver ..... 187/203

3,111,196 11/1963 Plassman ..... 187/216

FOREIGN PATENT DOCUMENTS 9209928 3/1993 Germany .

*Primary Examiner*—Kenneth Noland

*Attorney, Agent, or Firm*—Cohen, Pontani, Lieberman, Pavane

[57] ABSTRACT

A platform (1) for the storage or removal of motor vehicles (2) with at least two axles (4) in parking garages is used with multiple-occupancy parking devices having lifting devices (5) for the platforms (1). Openings (12) are provided in the platform base (1a), which openings (12) are covered by diaphragm-like permanently elastic plates (10a) in which indentations (10) are produced by the vehicle wheel (7). The platform is capable of receiving vehicle wheels (7) of various diameters (8) and/or widths (9).

11 Claims, 3 Drawing Sheets

Fig.1
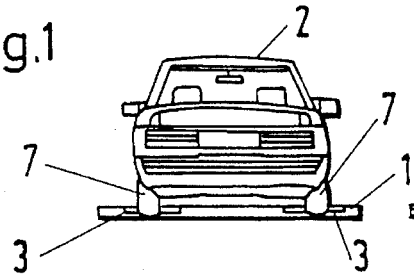
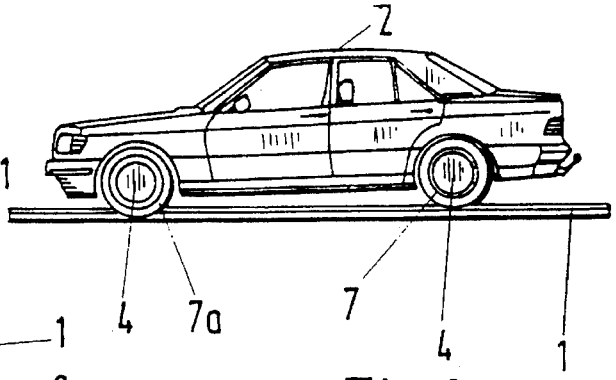
Fig.2
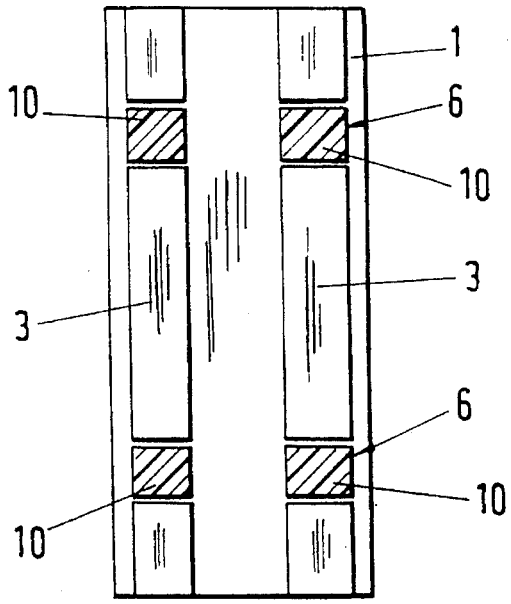
Fig.3
Fig.4
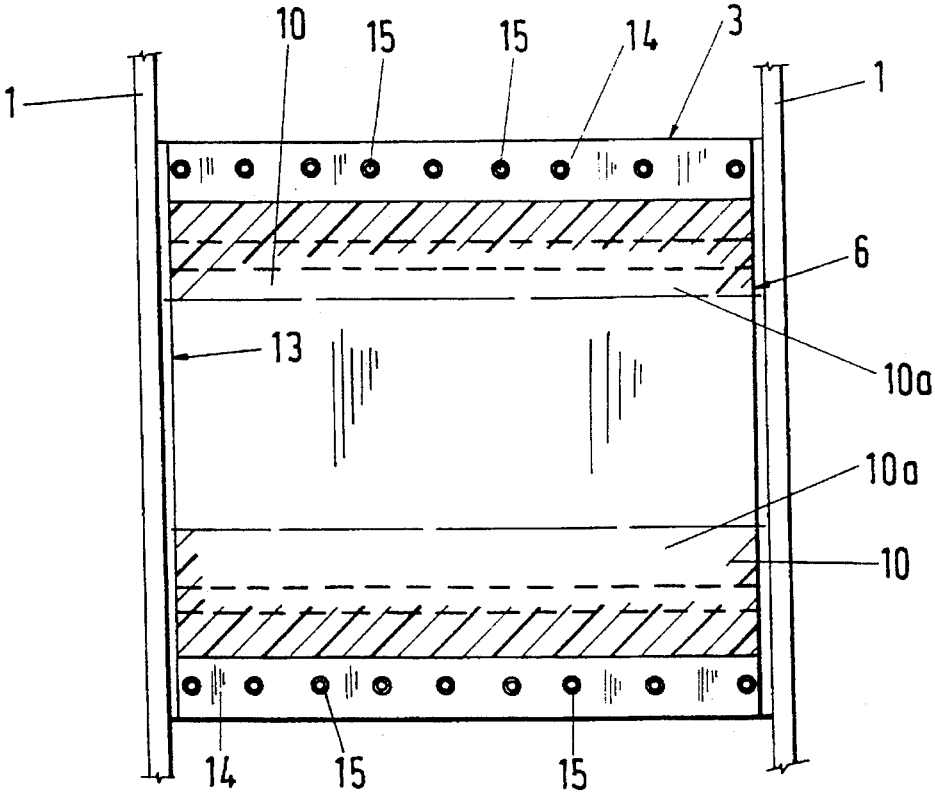

PLATFORM FOR STORAGE OR REMOVAL OF MOTOR VEHICLES IN PARKING GARAGES

BACKGROUND OF THE INVENTION

1. Field of the Invention

The invention is directed to a platform for storage or removal of motor vehicles in parking garages according to the preamble of claim 1.

2. Description of the Related Art

Platforms of this type are known (DE-GM 92 09 928). In a first embodiment form, it is suggested that a blocking device be associated with the front wheels or rear wheels of the motor vehicle so as to block them in a disengageable manner in order to eliminate the risk that the motor vehicles will roll off the pallets but so as to enable the motor vehicle to be driven off the palette under the power of the engine. This blocking device is constructed by providing palettes of a certain thickness with depressions which reduce the thickness of the palette. By driving the front wheels into these depressions, the motor vehicle is locked in and protected from rolling off.

Another embodiment form likewise shows a palette with depressions for the front and rear wheels of a motor vehicle. The depressions are formed by spring-mounted, vertically disposed crosspieces which form a depression which conforms as far as possible to the outer contour of the wheel when acted upon by the pressure of the wheel. After the motor vehicle is driven out of the depression, the crosspieces are moved back by the spring elements into their initial position in which they form a plane parallel to the rest of the platform.

SUMMARY OF THE INVENTION

The object of the present invention is to provide a platform for the storage and removal of motor vehicles in parking garages in which the motor vehicle is secured in a reliable manner and so as to be insusceptible to problems resulting from soiling.

According to the invention, this object is met in a platform embodying the features of claim 1. Further advantageous constructions are indicated in the subclaims.

According to the invention, openings which are closed by diaphragm-like permanently elastic plates are provided in the base of the platform to secure the motor vehicle in a dependable maimer in that its wheels sink into the plates. The parking palettes according to the invention offer a simply designed, economical solution for a large number of applications, in particular when the acceleration forces acting on the motor vehicle which is parked on the platform are not very great. Due to their elasticity, the permanently elastic plates adapt to the different contours and/or widths of the tires and provide the vehicle with high stability. The tires can also not be damaged. Further, the plates are watertight so that no rainwater or water from melting ice can collect below them. Collecting water can run off by itself via the track channels when driving the vehicle out by raising the trough into the planar initial position.

For applications in which high holding forces are required for the motor vehicle on the parking palette, the openings are made larger or the permanently elastic plate is made more flexible so that the wheels of the motor vehicle can sink deeper. The permanently elastic plates are supported in a planar horizontal manner by stationary lift elements supporting these plates in order to make it easier to drive into these parking palettes. The driver of the vehicle can be directed into the desired position in which to park the vehicle via active sensing equipment. The respective lift elements are then lowered (together or successively) so that the permanently elastic plate forms a trough for each front wheel of the vehicle and holds the vehicle securely. When removing the vehicle, the initial position is restored by raising the lift elements into the drive-out plane. In the event that water which has collected while the vehicle is parked freezes, the ice is broken by the lifting process. Owing to the lift elements, the vehicle can be driven in and driven out in a "planar" manner so that there is no increase in driving resistance and the wheels cannot slip.

According to a further development, rectangular recesses or cut-outs are provided in the base of the platform which correspond to the average distance between the tracks of a plurality of motor vehicles. These cut-outs facilitate the securing of the clamping plate, wherein the diaphragm-like permanently elastic plate is held by means of the flanged clamping plate which extends circumferentially around the edge of the cut-out and is fastened by screws.

Further, the permanently elastic plate is advantageously formed of flexible plastics, e.g., polyamides with or without glass-fiber reinforcement.

The various features of novelty which characterize the invention are pointed out with particularity in the claims annexed to and forming a part of the disclosure. For a better understanding of the invention, its operating advantages, and specific objects attained by its use, reference should be had to the drawing and descriptive matter in which there are illustrated and described preferred embodiments of the invention.

BRIEF DESCRIPTION OF THE DRAWINGS

In the drawings:

FIG. 1 shows a rear view of a passenger automobile standing in track channels of a platform;

FIG. 2 shows a side view corresponding to FIG. 1;

FIG. 3 shows a top view of a platform with four permanently elastic plates;

FIG. 4 shows an enlarged top view of a unit of the permanently elastic plates;

DETAILED DESCRIPTION OF THE PRESENTLY PREFERRED EMBODIMENTS

Figure 5:
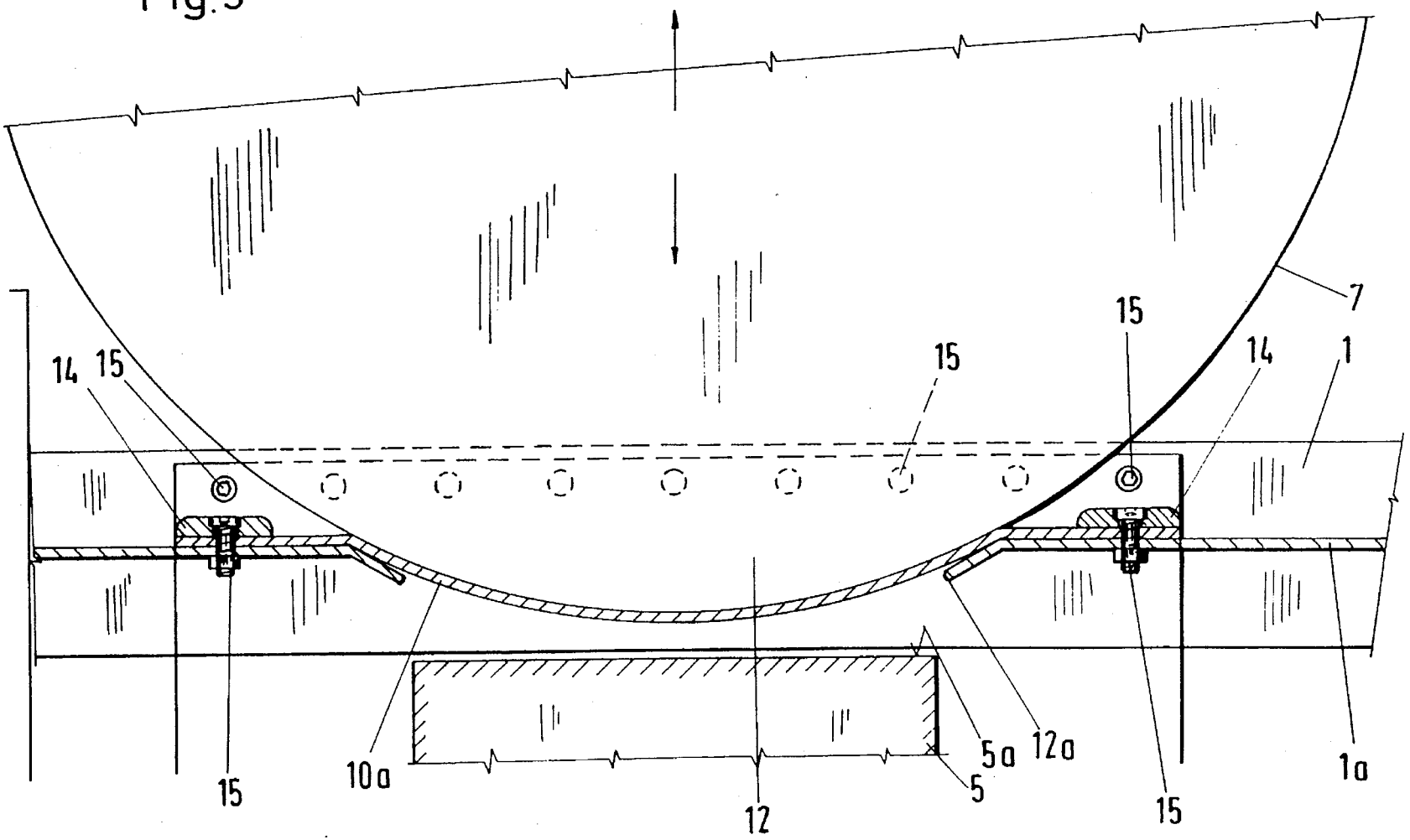
FIG. 5 shows a vertical section through the platform, the permanently elastic plate and the lift element.

The platform 1 with a platform base 1*a* for storing and removing motor vehicles 2 in parking garages has track channels 3. The track channels 3 make it easier for the driver of the motor vehicle 2 to drive onto the platform. The motor vehicle 2 which has at least two axles 4 is parked in a multiple-occupancy parking device. Depressions 6 for receiving vehicle wheels 7 of various diameters 8 and/or various widths 9 are incorporated in the respective track channels 3. In contrast to conventional track channels 3 with depressions reducing the thickness of the track channels, the present substantially parallel track channels 3 are provided with formed in portions or indentations 10 which are changeable over time and are produced by the vehicle wheels 7. In order to eliminate the indentations 10 again, this embodiment form is provided with lifting devices 5 which raise the vehicle wheels 7 to a normal level for driving the motor vehicle 2 in and out. The motor vehicle 2 is already adequately secured when the indentations 10 which are changeable over time are provided only for the front wheels 7*a* of the motor vehicle.

Figure 6:
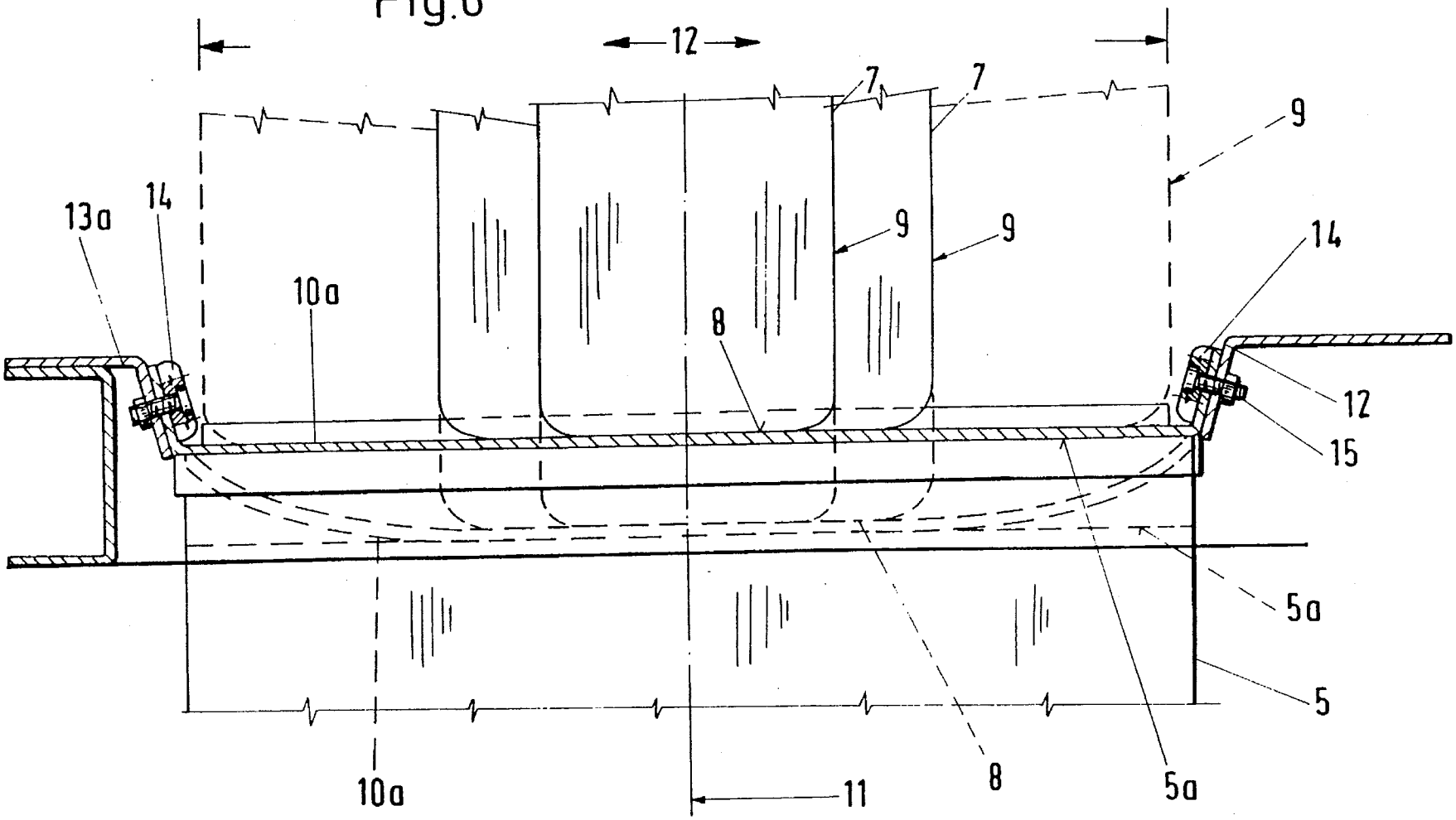
FIG. 6 shows a cross section corresponding to FIG. 5.

Permanently elastic plates 10*a* which are arranged in pairs corresponding to the average distances 11 between the track channels of the motor vehicles 2 as represented by adjacent wheels on vehicle 2 and which contact a planar lift element 5*a* of the lifting device 5 are fastened in the platform base 1*a*. These permanently elastic plates 10*a* close or cover an opening 12 in the platform base la having an opening rim 12*a*. The opening 12 is designed as an angled rectangular cut-out 13. A clamping plate 14 extending circumferentially around the opening downwardly flared edge 12*a* is fastened to a cut-out edge 13*a* by screw connections 15 (FIGS. 5 and 6). The permanently elastic plate 10*a* is formed of plastics of various types and composition, e.g., polyamides with or without glass-fiber reinforcement are suitable for this purpose.

While the motor vehicle 2 is driven in or out, the flat horizontally planar lift element 5*a* supports the permanently elastic plate 10*a*. During the time between these processes, the lift element 5*a* is lowered by several millimeters so that the permanently elastic plate 10*a* sags and forms a trough corresponding to the proportional weight of the motor vehicle 2 so as to secure the motor vehicle 2 in the parked position. The trough formation or sagging can also be limited (FIGS. 5 and 6). FIG. 5 shows the parked position and FIG. 6 shows the drive-in and drive-out positions.

For applications in which the acceleration forces acting on the motor vehicle 2 parked on the platform 1 are not very high, the openings 12 can be smaller. Accordingly, although the holding forces acting on the motor vehicle 2 are reduced since the vehicle wheels 7 do not sink into the indentations 10 as deeply, the lifting device 5 can be dispensed with because the motor vehicle 2 can be driven out of the indentations 10 reliably without having to overcome excessive holding force.

The invention is not limited by the embodiments described above which are presented as examples only but can be modified in various ways within the scope of protection defined by the appended patent claims.

What we claim and desire to protect by letters patent is:

1. A platform base, suitable for storage or removal of a variety of motor vehicles having at least two axles and having wheels mounted thereon, each said wheel having a predetermined contour, diameter and width; and a lifting device positioned beneath said platform which operates in cooperation with said platform;

said platform base having an upper surface and a lower surface with an opening therethrough at a location corresponding to the location of each said wheel of said motor vehicle during storage on said upper surface of said platform base, each said opening covered by a diaphragm comprising an elastic plate having an indentation therein and adapted to receive one of said wheels, said indentation resulting from said elastic plate adapting to said contours and said width of said wheel during storage on said platform with the result that said indentation of said plate extends beneath said lower surface of said platform when said vehicle is stored thereon.

2. The platform defined in claim 1 wherein said lifting device is positioned beneath each said opening through said lower surface of said platform base and which is capable of being actuated to contact and raise said plastic plate to eliminate said indentation so that said plastic plate is even with said upper surface of said platform.

3. The platform defined in claim 2 wherein said motor vehicle stored on said platform has front wheels and rear wheels and said plastic plates, each with said indentation are changeable and are provided for said front wheels of said vehicle only.

4. The platform defined in claim 3 wherein said plastic plates, each with said indentation are changeable and are provided for said rear wheels of said vehicle only.

5. The platform defined in claim 2 wherein two substantially parallel track channels are provided in said upper surface of said platform base and wherein said openings possess a rim and are arranged in pairs adjacent each other to receive said wheels of said vehicle, and wherein said lifting device is capable of contacting said plates which are held at said rim of said opening.

6. The platform defined in claim 3 wherein there is a mean distance between said adjacent wheels of said variety of vehicles which are stored on said platform and wherein said openings are rectangular in shape and are positioned in said platform to coincide with said mean distance between said adjacent wheels and to receive said wheels when a vehicle is stored on said platform.

7. The platform defined in claim 6 wherein said opening is bordered by a flared edge that extends downwardly from the upper surface of said platform, and a flanged clamping plate which extends circumferentially around said flared edge and which secures said plastic plate by fastening means to said flared edge.

8. The platform defined in claim 7 wherein said fastening means are screws.

9. The platform defined in claim 5 wherein said elastic plate is formed of flexible plastic.

10. The platform defined in claim 9 wherein said flexible plastic is polyamide.

11. The platform defined in claim 10 wherein said polyamide is reinforced with fiber-glass.

* * * * *